United States Patent [19]

Sansum

[11] 4,243,077

[45] Jan. 6, 1981

[54] PACKAGE STRAPPING TOOLS

[75] Inventor: Robert D. Sansum, Harpenden, England

[73] Assignee: Gerrard Industries Limited, Kilnhurst, near Rotherham, England

[21] Appl. No.: 42,243

[22] Filed: May 24, 1979

[30] Foreign Application Priority Data

May 25, 1978 [GB] United Kingdom ..... 22590/78

[51] Int. Cl.[3] ..... B21F 21/00

[52] U.S. Cl. ..... 140/93.4; 100/4; 100/30; 53/592

[58] Field of Search ..... 140/93.2, 93.4, 123.5, 140/123.6; 53/582, 589, 592; 100/4, 30

[56] References Cited

U.S. PATENT DOCUMENTS

| | | | |
|---|---|---|---|
| 3,470,814 | 10/1969 | Tschappu | 100/4 |
| 3,506,041 | 4/1970 | Angarola | 140/93.4 |
| 3,863,684 | 2/1975 | Simmonx | 140/93.4 |

*Primary Examiner*—Richard B. Lazarus

*Attorney, Agent, or Firm*—Kemon & Estabrook

[57] ABSTRACT

A package strapping tool of the fluid pressure operating type embodying tensioning means for tightening a loop of strapping around a package and joining means for securing together overlapped portions of the loop. The tensioning means and the joining means are operated by hydraulic or pneumatic means wherein the initiation of the joining operation is controlled through a time delay device the timing cycle of which is started by the application of fluid pressure to the tensioning means. The time delay device is preferably of a pneumatic or hydraulic type which uses for its own operation the fluid which is suppled under pressure to operate the tool. The time delay device is preferably adjustable whereby the cycle of the tool may be varied dependent upon circumstances and the timing cycle maybe started by the supply of fluid pressure to the tensioning means.

15 Claims, 12 Drawing Figures

PACKAGE STRAPPING TOOLS

Figure 1:
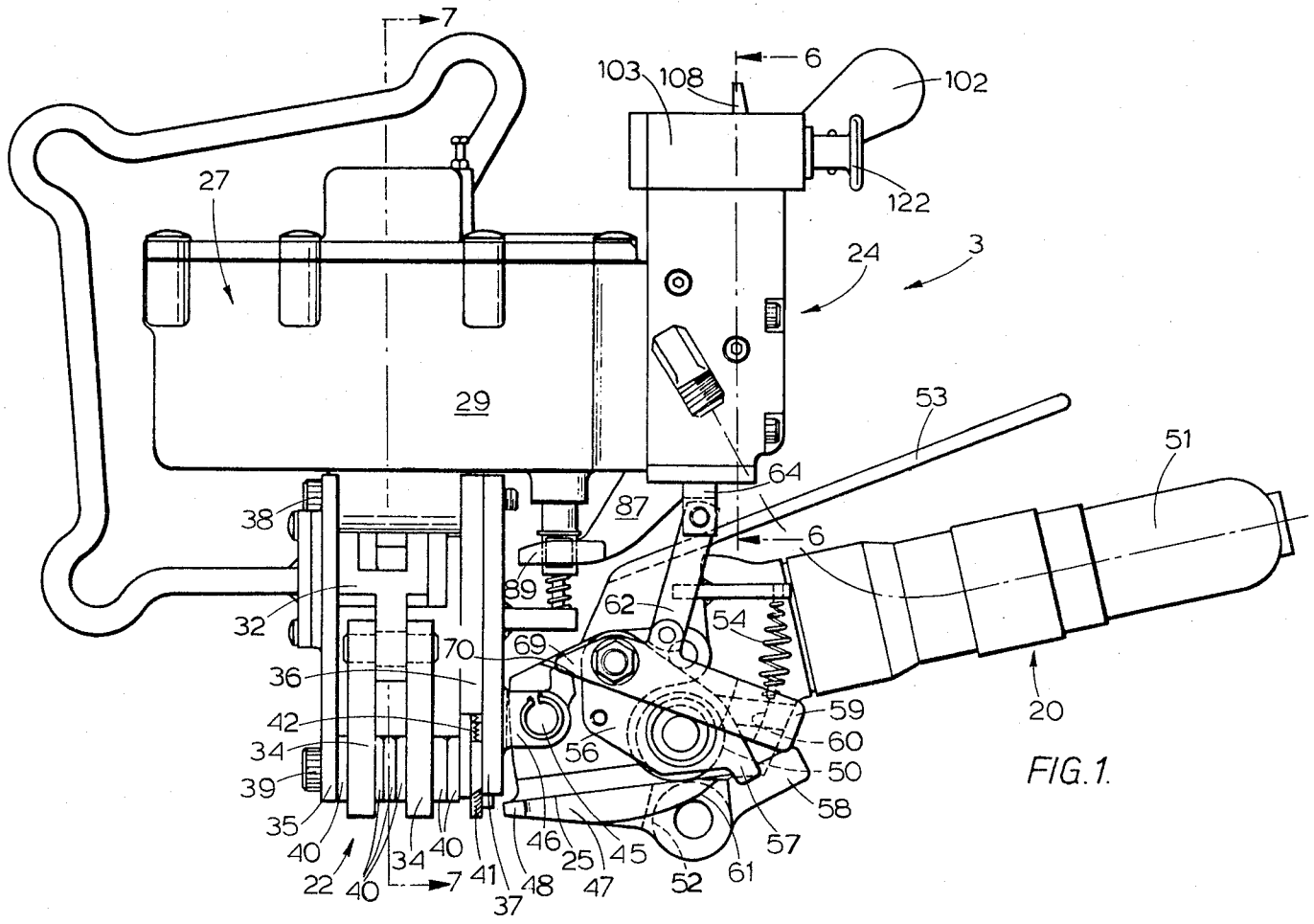

This invention relates to fluid-pressure operated package strapping tools of the kind which includes tensioning means for tightening a loop of strapping around a package and jointing means for securing together the overlapped strapping portions. The fluid-pressure operation of both the tensioning means and the jointing means is usually by compressed air but sometimes hydraulic pressure is used. Such tools are hereinafter referred to as package strapping tools of the kind described.

In package strapping tools of the kind described separate operator controls are often provided for the tensioning means and the jointing means. Skill and judgement is required in operating these controls. If the operator stops the tensioning means too soon or operates the control of the jointing means prematurely the strapping will not be fully tightened.

Control of the maximum tension of the strapping in tensioning means including an air motor is usually by arranging that the motor stalls when full tension has been applied.

When the air motor stalls, the air pressure applied to it reaches a peak. It is known to use this peak pressure to trigger the operation of the jointing means. When strapping some kinds of packages consolidation occurs even after full tension has been applied by the tensioning means and unless tension is maintained and the loop contracted appropriately during consolidation and before the joint is made, the loop will be too slack.

A package strapping tool of the kind described and designed to meet such a condition is the subject of our U.K. Patent Specification 1 423 688 in which the tensioning means comprises a rotary dog driven by an air motor and a sensor is provided to indicate the depth of penetration into the tensioned strip of the rotary dog.

It is an object of the present invention to provide means of obtaining greater control of the initiation of the jointing operation.

The present invention consists in a fluid-pressure operated package strapping tool of the kind which includes tensioning means for tightening a loop of strapping around a package and jointing means for securing together overlapped portions of the loop, both the tensioning means and the jointing means being powered by pneumatic or hydraulic fluid-pressure wherein initiation of the jointing operation of the jointing means is controlled through a time delay device the timing cycle of which is started by the application of fluid-pressure to the tensioning means.

The time-delay is preferably adjustable so that the cycle of the tool can be varied to suit different circumstances. The time-delay device could be of any known kind, for example, an electronic device, the timing cycle of which is started by a pressure-sensitive switch. It is preferred however that the time-delay device is pneumatic or hydraulic and uses for its own operation the fluid which is supplied under pressure to operate the tool. The timing cycle may be started by the supply of fluid pressure to the tensioning means. In one form of the invention the time-delay device comprises a restrictor in a passage supplying fluid pressure to a chamber open to pressure-sensitive means for operating a pilot valve which operates through a servo system a sealing valve controlling the supply of fluid under pressure to the jointing means. The pilot valve may be biassed towards the closed position by the supply pressure against which it must be opened by the pressure-sensitive means. The pressure in the chamber and therefore applied to the pressure-sensitive means rises gradually, depending upon the opening of the restrictor, the volume of the chamber and to a certain extent the supply pressure. The relative effective areas of the pressure-sensitive means and the sealing valve are such that when the pressure in the chamber reaches a pre-determined value, the pressure-sensitive means opens the pilot valve to operate the jointing means.

The restrictor may be adjustable for setting or varying the time delay. The volume of the chamber may alternatively or additionally be variable for the same purpose.

In another form of the invention supply pressure is applied to one side of a piston working in a cylinder. The piston has a piston rods which towards the end of the piston stroke engages and operates a pilot valve in a servo system controlling the jointing means. A restrictor controls the escape of fluid from the cylinder on the other side of the piston. The opening of the restrictor regulates the time for supply pressure to move the piston along the cylinder and the time delay before the pilot valve is opened. In this case also the restrictor may be adjustable for varying the time delay. The time delay could also be made variable by providing means of adjusting the distance between the piston and cylinder assembly and the pilot valve so that the piston need not make its full stroke before engaging the pilot valve.

Means may be provided for manual operation of the jointing means to replace or override the time delay when required. For example, in the above-described forms of the invention direct manual control of the pilot valve may be provided or means, such as a manually operable spring-loaded valve, for, in effect, by-passing the restrictor.

The timing of the operation of the jointing means in a package strapping tool according to the invention is not dependent on strap thickness as is the case with the tool of Patent Specification 1 423 688 and has advantage in some circumstances.

The invention is especially useful in a package strapping tool of the so-called "pusher bar" type in which the jointing means is hinged to a frame supporting the tensioning means to allow the strapping to be inserted laterally into the tensioning means in such a way that a wedge-shaped strap foot, forming part of the frame, is interposed between the loop of strapping close to a seal surrounding the overlapped ends of the loop and the adjacent supply or spare end of the loop. Tension is applied by the tensioning means to the supply or spare end of the loop. After insertion of the strapping the strap foot is closed by swinging the jointing means and the frame with the tensioning means one towards the other. This brings the toe of the strap foot close to the end of the seal to support the seal and strapping during tensioning.

The relative hinging movement between the jointing means and the frame carrying the tensioning means would make it difficult to apply the mechanism described in Patent Specification 1 423 688 to a pusher-bar tool. The present invention provides a useful alternative.

In package strapping tools of the kind described it is important that tension should be maintained on the strapping by the tensioning means until the jointing means has completed its operation. According to a further feature of the invention means is provided for holding in the actuation position a valve supplying fluid under pressure to the tensioning means and means for releasing the holding means on completion of the movement of the jointing means in the direction for making the joint.

In jointing means operated by a jointing or sealing piston and cylinder assembly the releasing means may comprise a member engaged by the piston at the end of its travel. The member may be a plunger slidably mounted in the jointing or sealing cylinder parallel to the axis of the piston. A linkage interconnects the plunger with a self-engaging latch forming the holding means and which engages automatically when the valve supplying fluid under pressure to the tensioning means is actuated so as to retain the tensioning valve in the actuated condition.

Figure 2:
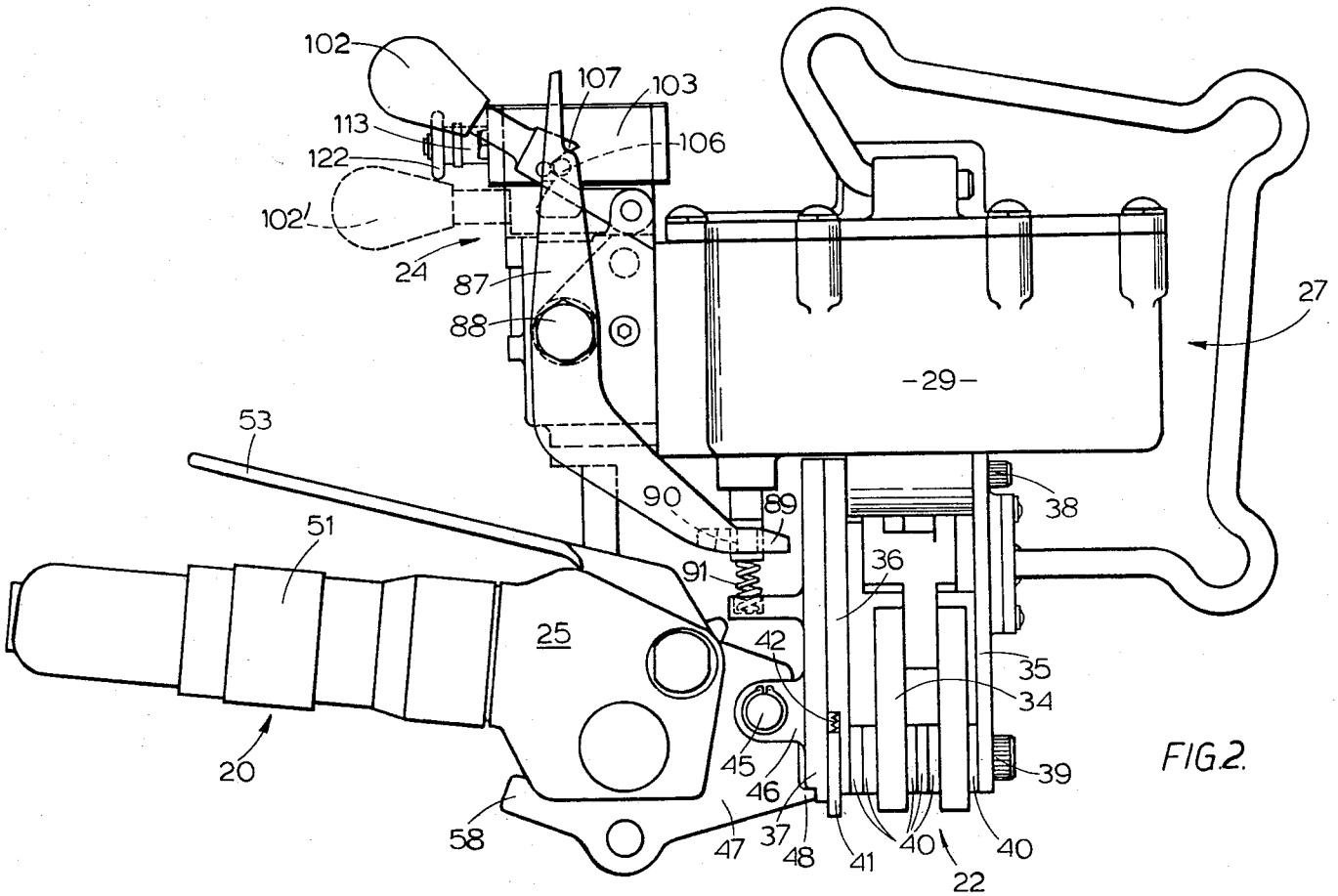
Figure 3:
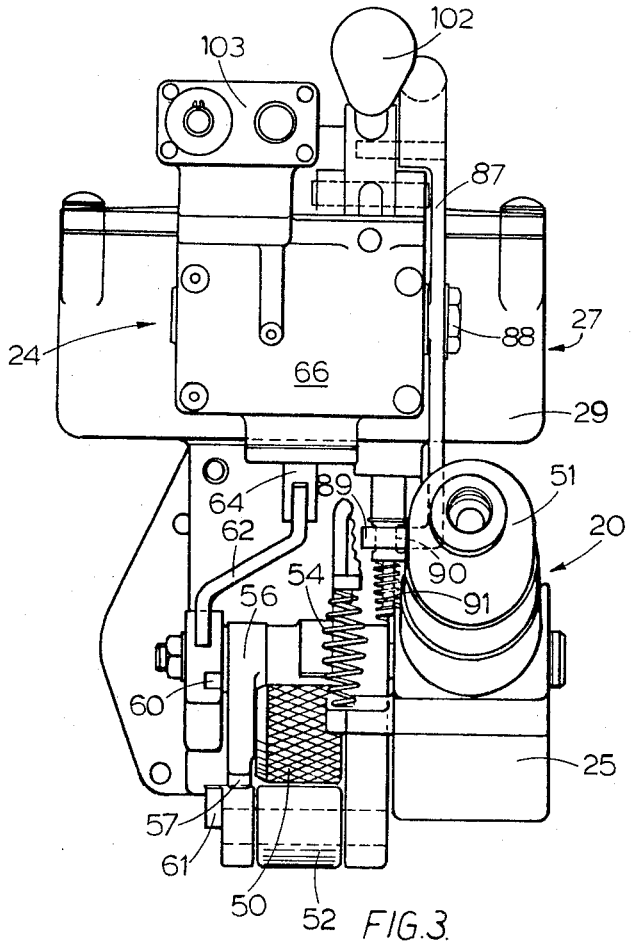
Figure 4:
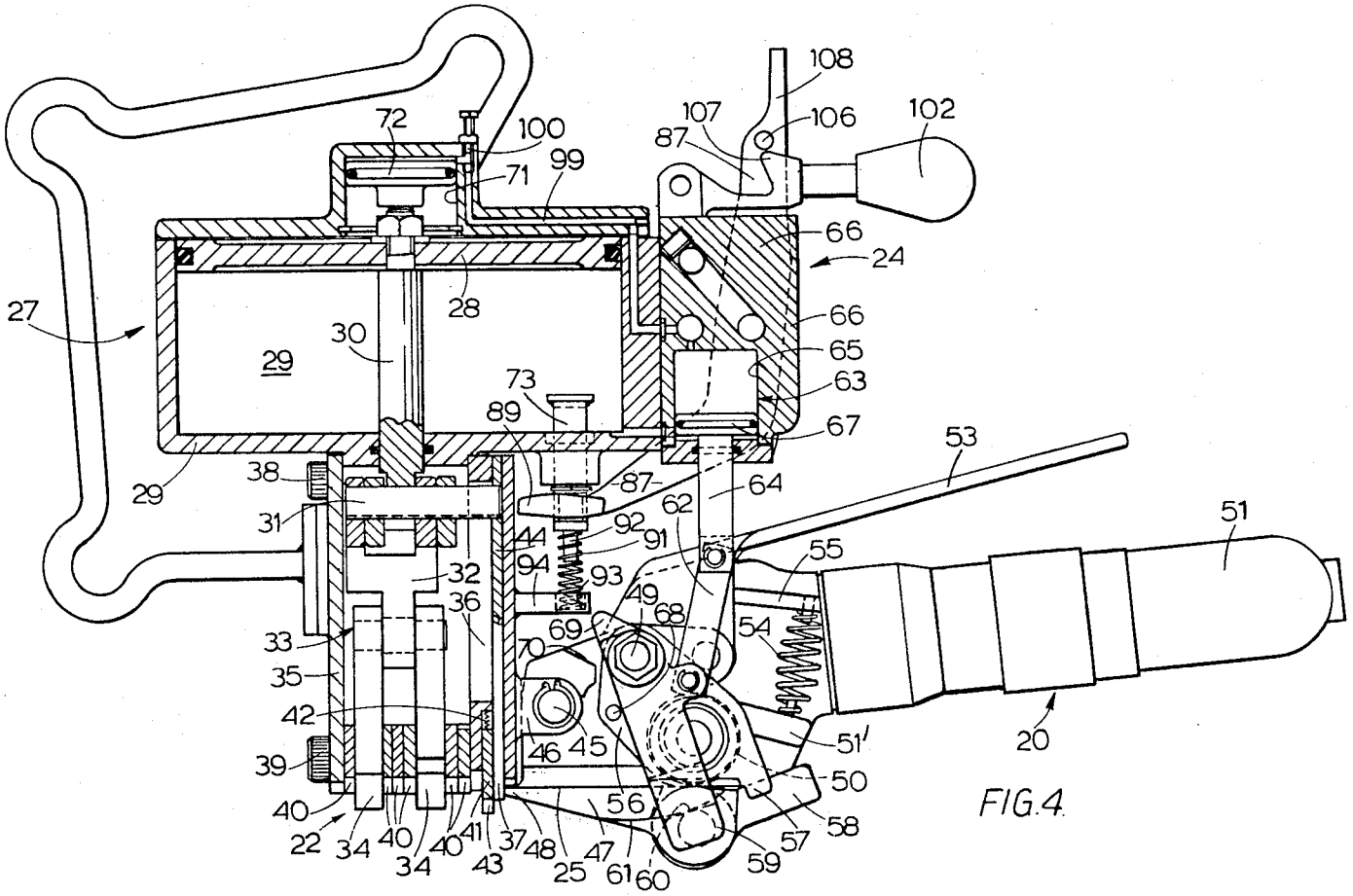
Figure 5:
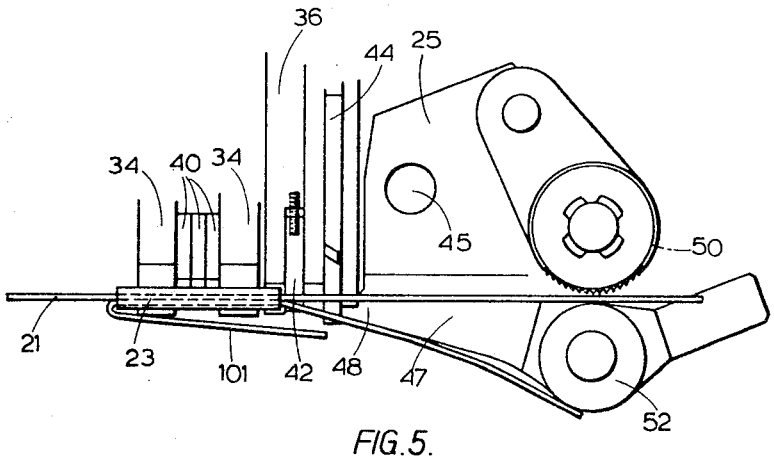
Figure 6:
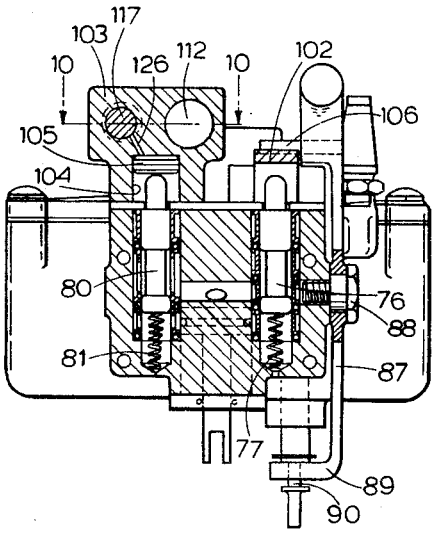
Figure 7:
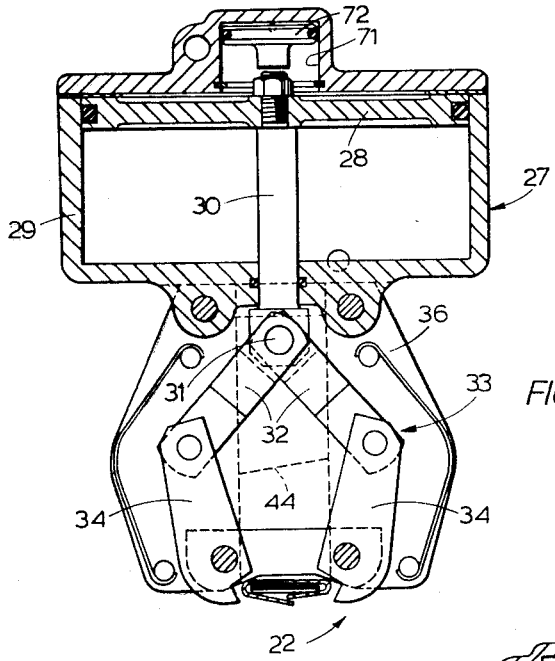
Figure 8:
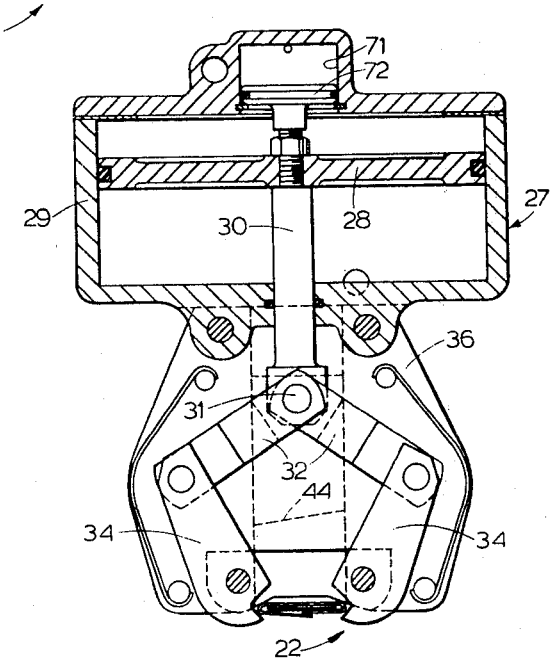
Figure 9:
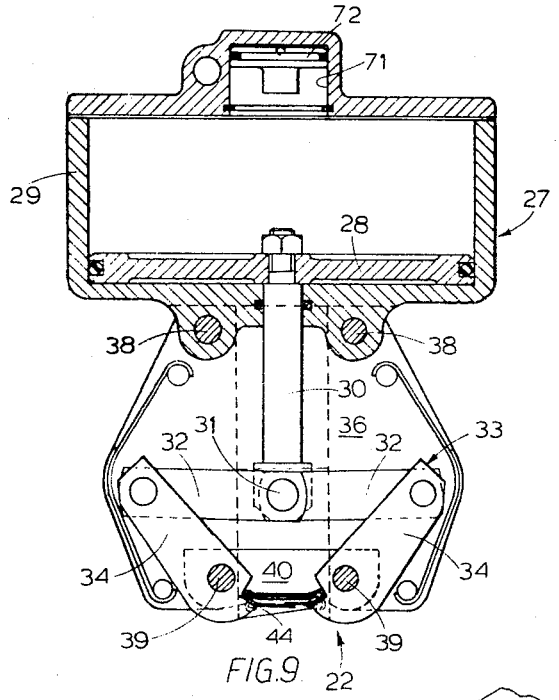
Figure 11:
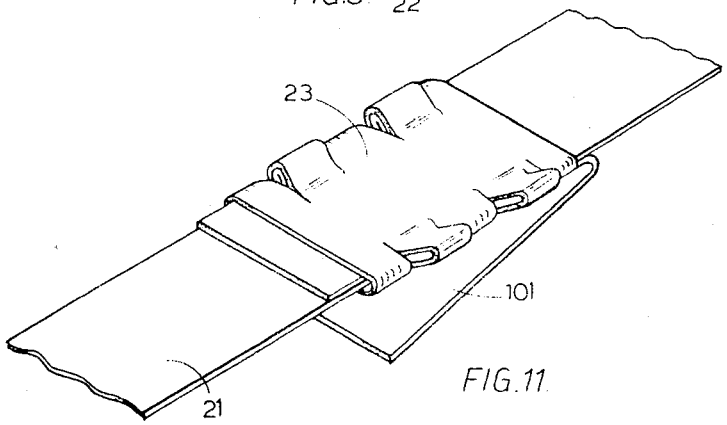
Figure 10:
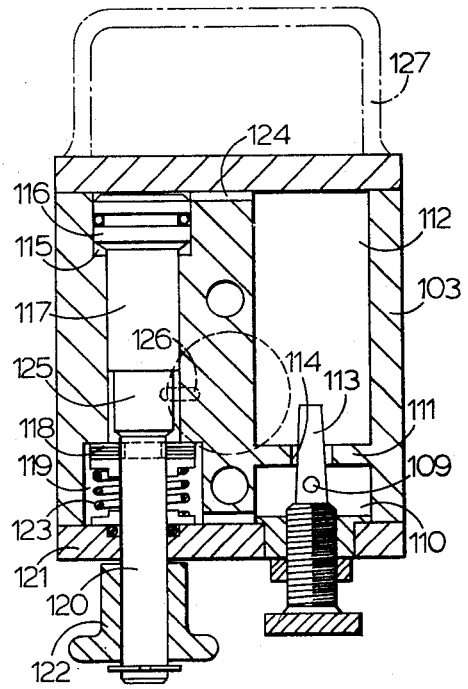

Embodiments of the invention will now be described by way of example, with reference to the accompanying drawings in which:

FIG. 1 is a front view of one form of strapping tool according to the invention, FIG. 2 is a rear view and FIG. 3 an end view in the direction of arrow 3 in FIG. 1, FIG. 4 is a view similar to FIG. 1 but partly in section, FIG. 5 is a fragmentary view of part of FIG. 4 with the inclusion of package strapping, FIG. 6 is a partial section on line 6—6 of FIG. 1, FIG. 7 is a section on line 7—7 of FIG. 1, FIGS. 8 & 9 are sections similar to FIG. 7 showing different stages in the operation of the tool, FIG. 10 is an enlarged section on line 10—10 of FIG. 6, and FIG. 11 is a perspective view of a completed package strapping joint made by the strapping tool of FIGS. 1 to 10, and FIG. 12 is a view partly in section of a modification.

The strapping tool illustrated in FIGS. 1 to 10 of the drawings is operated by compressed air and is of the so-called "pusher bar" type which avoids the use of a base plate interposed between the strapping and a package being secured. The strapping tool comprises an air-driven tensioning motor assembly 20 for tightening a metal strap 21 (FIGS. 5 and 11) around the package, a crimping device 22 for securing together overlapping portions of the strap 21 within a surrounding metal seal 23 and a valve assembly 24 by which the operation of the strapping tool is controlled.

The tensioning motor assembly 20 and the crimping device 22 are both pivoted to a frame 25 to enable the tool to be opened for easier engagement with a loop of strapping and closed for operating upon it.

The crimping device 22 is operated by a large double acting, jointing or sealing, piston and cylinder assembly 27 with a piston 28 (FIG. 4) working in a cylinder formed in a housing 29. The piston 28 is mounted on a piston rod 30 which extends through the bottom of the housing 29 to be connected by a transverse pin 31 (FIGS. 4 and 7) to a pair of links 32 of a toggle linkage 33 for operating crimping jaws 34. A front plate 35 lies on one side of the toggle linkage. An intermediate plate 36 and a back plate 37, in contact with one another, lie parallel to the front plate 35 on the opposite side of the toggle linkage. The plates 35, 36 and 37 are secured to the housing by bolts 38 and further bolts 39 near the lower corners of the plate provide pivots for the jaws 34. The bolts 39 also support fixed blades 40 against each face of each jaw 34 with which they co-operate the crimp the seal and make the joint in the strapping.

A seal stop 41 is slidably mounted in the intermediate plate 36 and urged towards a projecting position by a spring 42. A gap 43 (FIG. 4) is provided in the bottom edge of the seal stop 41 to receive the strapping so that the seal stop 41 straddles it and acts as a guide during tensioning as well as providing an abutment for the rear end of the seal. In the face of the back plate 37 that is against the intermediate plate 36 is formed a slideway for a cutter 44. As visible in FIG. 4 the transverse pin 31 projects through a slot in the intermediate plate 36 to engage a hole in the cutter 44 which is therefore moved along the slideway by the pin 31.

The crimping device 22 is pivoted to the frame 25 by a pivot pin 45 which passes through lugs 46 projecting from the back plate 37 and a bore in the frame 25. Forming part of the frame 25 is a strap foot 47 which tapers towards a toe 48. In the closed position of the tool the toe 48 bears against the bottom edge of the back plate 37 and the front edge projects forward to a position in which it co-operates with the cutter 44 in severing surplus strapping from the completed joint.

The motor assembly 20 is pivoted to the frame 25 by a pivot pin 49. A rotary dog 50 (FIGS. 1, 3 and 4) for tensioning the strapping is driven by an air motor 51 of the motor assembly 20 through suitable gearing. There is a roller 52 rotatably mounted in the strap foot 47 opposite the rotary dog 50 to support the strap against the pressure of the rotary dog during tensioning. The roller 52 is rotatable with the object of reducing friction.

A hand lever 53 rigidly mounted on the frame 25 extends above the body of the motor 51. By squeezing the hand lever 53 and the motor 51 together, the motor 51 can be raised to lift the rotary dog 50 away from the strap foot to enable the strap to be inserted between the rotary dog 50 and the roller 52. A barrel-shaped compression spring 54 mounted between a bracket 55 rigid with the hand lever 53 and a lug 51' on the casing of the motor assembly urges the rotary dog 50 towards the roller 52. An outrigger bracket 56 supported by the motor pivot 49 carries an outer end bearing for the shaft on which the rotary dog 50 is mounted. A downward projection 57 of the outrigger bracket forms an outer edge strap guide and an upwardly inclined tail 58 on the strap guide provides a guide for the inner edge of the strapping. Outside the outrigger bracket 56 a strap foot restrainer 59 (FIGS. 1, 3 and 4) is swivelling mounted on the motor pivot 49. On its inner face the strap foot has an arcuate groove 60 to receive a lateral projection 61 on the strap foot when the strap foot restrainer 59 is swung downwards. The under face of the projection 61 has a curved surface centred on the motor pivot 49 and engages the facing side of the groove 60 to resist deflection of the strap foot during strap tensioning. A link 62 couples the strap foot restrainer 59 to an auxiliary double-acting piston and cylinder assembly 63. The link 62 is pivotally connected to the strap foot restrainer 59 and to a piston rod 64. A cylinder 65 (FIG. 4) of the piston and cylinder assembly 63 is formed in a body 66 of the valve assembly 24 and its piston 67 is connected to the piston rod 64. In its outstroking direction the piston 67 swings the strap foot restrainer 59 clockwise (as viewed in FIGS. 1 and 4) engaging the lateral projection 61 with the groove 60. The movement continues until the strap foot restrainer 59 meets a peg 68 protruding from the outrigger bracket 56 on which it acts to urges the motor assembly 20 about the motor pivot 49 in a clockwise direction (as shown in FIG. 4) so as to urge the rotary dog 50 harder against the strapping. If frictional contact between the strap foot restrainer 59 and the strap foot 47 has not already caused the strap foot 47 to move towards the crimping device 22, the force applied to the strap foot 47 through the rotary dog 50, by the action of the auxiliary piston and cylinder assembly 63, will urge the toe 48 of the strap foot 47 towards the back plate 37.

In the opposite direction the auxiliary piston and cylinder assembly 63 moves the strap foot restrainer 59 anti-clockwise, disengaging its groove 60 from the lateral projection 61 and out of the way of the strap being inserted between the rotary dog 50 and the roller 52. Towards the end of the anti-clockwise movement of the strap foot restrainer 59 a tail 69 of the strap foot restrainer 59 engages an abutment 70 (FIGS. 1 and 4) on the frame 25 so that the strap foot restrainer 59 and the frame 25 together move anti-clockwise about the pivot pin 45 swinging the strap foot 47 away from the back plate 37 ready for engagement of the tool with the loop of strapping.

In the cylinder housing 29 above the large piston 28 is a small co-axial partial-close cylinder 71 (FIGS. 4 and 7 to 9) with a piston 72 which abuts the large piston 28 when the piston 28 is at the top of its stroke. When air under pressure is admitted to the top of the partial close cylinder 71, the piston 72 moves from the position shown in FIG. 7 and bears on the large piston 28 and moves the piston rod 30 to close the crimping jaws 34 around the seal 23 (as shown in FIG. 8) whilst strap tensioning takes place. By this means the seal 23 is retained and prevented from being pulled out of the jaws as a result of curvature or irregularities in the package surface.

At the bottom of the cylinder housing 29 a plunger 73 (FIG. 4) is slidably mounted for movement parallel to the piston rod 30. It is spring biassed to project into the cylinder. Towards the lower end of its stroke and the piston 28 depresses the plunger 73 indicating that the crimping operation powered by the piston and cylinder assembly 22 has been completed. The way in which use is made of this indication will be described later.

The valve assembly 24 comprises a tension valve 74 and a sealing valve 75. The tension valve has a slidable valve spool 76 (FIG. 6) urged upwards by a spring 77 against a pivoted tool operating lever 102 by which the spool 76 can be manually depressed. Moving the tension valve spool downwards supplies compressed air under pressure to the top of the piston 67 of the auxiliary piston and cylinder assembly 63, and opens its underside to atmosphere, supplies air to air motor 51 and to the top of the co-axial cylinder 71 through a passage 99 (FIG. 4). The underside of the large piston 28 is also opened to atmosphere. The passage 99 includes a screw-down valve 100 which enables the passage 99 to be closed so that pressure air can be prevented from reaching the co-axial cylinder 71 if the previously described action of the piston 72 in partly closing the crimping device is not required.

A timer valve block 103 mounted on top of the body 66 of the valve assembly 24 includes a sealing valve cylinder 104 (FIG. 6). A sealing valve piston 105 works in the cylinder 104 and when energised actuates a valve spool 80 of the sealings valve 75. The valve spool 80 is urged upwards by a spring 81. Moving the sealing valve spool 80 downwards supplies pressure air to the top of the cylinder of the main piston and cylinder assembly 27.

A cranked lever 87 (FIGS. 2, 3 and 4) is pivotally mounted about a pivot pin 88 on the body 66 of the valve assembly 24. The lower end of the cranked lever 87 extends under the edge of the cylinder housing 29 and has a lateral extension 89 which is bifurcated and embraces a circumferential groove 90 in the plunger 73 where it projects below the cylinder housing 29. The upper end of a helical compression spring 91 surrounds a spigot 92 at the lower end of the plunger 73. The lower end of the spring 91 is received in a pocket 93 in a lug 94 projecting from the back plate 37. The spring 91 urges the plunger 73 upwards and the cranked lever 87 in an anti-clockwise direction in FIG. 2. At its upper end the cranked lever 87 has a bar 106 which overlies the operating lever 102. In the "off" position of the operation lever 102 shown in full lines in FIG. 2 of the bar 106 lies under a nose 107 formed on the lever 102. When the operating lever 102 is depressed to actuate the tension valve 74 it is moved to the "on" position shown in FIG. 4. In reaching this position the bar 106 and the cranked lever 87 are deflected by the nose 107 against the action of the spring 91 which in the "on" position moves the bar 106 over the top of the nose as also shown by dot-dash lines at 102' in FIG. 4 to hold the tension lever 102 "on". The cranked lever 87 has an upward extension 108 for convenience in manually releasing the tension lever 102 if this should be necessary before the completion of the strapping operation, perhaps because of misalignment of the strapping. The plunger 73, cranked lever 87, spring 91, bar 106 and nose 107 thus constitute a self-engaging latch to retain the operating lever 102 in the operative position until the plunger 73 is engaged by the piston 28 at the end of its downward movement. The piston 28 reaches this position when the sealing operation has been completed. Depression of the plunger 73 by the piston 28 releases the latch so that the operating lever 102 returns to its initial position under the pressure of the tension valve spool spring 77.

When the operating lever 102 is moved to the "on" position, downward movement of the tension valve spool 76 connects the compressed air supply through a port 109 (FIG. 10) in the valve block 103 to an ante-chamber 110. A wall 111 separates the ante-chamber 110 from a chamber 112 of a time-delay device. An adjustable tapering valve member 113 extends through an opening 114 in the wall 111 and thus forms an adjustable restrictor controlling the flow of air into the chamber 112. Parallel to the chamber 112 in the timer valve block 103 is a cylinder 115 in which works a pilot valve operating piston 116 having a shank 117 which abuts a co-axial pilot valve disc 118 mounted in a valve chamber 119 on a slidable plunger 120 which extends through a gland in an end cap 121 of the valve chamber 119. A knob 122 for direct manual operation of the pilot valve disc 118 is fitted to the exposed end of the plunger 120. A light compression spring 123 normally seats the pilot valve disc 118. Like the ante-chamber 110 the valve chamber 119 is also connected to the compressed air supply when the tension valve spool 76 is moved downwards and this pressure acting on the annular area of the pilot valve disc 118 surrounding the plunger 120 also holds the pilot valve disc 118 on its seat.

A passage 124 connects the chamber 112 to the part of the cylinder 115 beyond the crown of the pilot valve operating piston 116. The differential effective areas of the piston 116 and the annulus of the valve disc 118 are such that as the pessure in the chamber 112 approaches supply pressure the force on the pilot valve operating piston 116 is greater than the force holding the pilot valve disc 118 on its seat. When this occurs the pilot valve disc 118 opens and admits compressed air around a reduced diameter portion 125 of the piston shank 117 and through a port 126 (FIGS. 6 and 10) to the sealing valve cylinder 104 above the sealing valve piston 105 which then moves the sealing valve spool 80 downwards to actuate the jointing mechanism. Slight clearance is allowed between the sealing valve piston 105 and its cylinder 104 and no seal is fitted to it. The slight leakage which occurs while the piston is holding the spool 80 down is tolerable. The clearance ensures that air trapped above the piston 105 at the end of the operation of the tool will not interfere with the return of the spool to its upper position by the spring 81.

If a longer delay is required the chamber 112 can be enlarged by fitting an extended back cover 127 indicated in dot-dash lines in FIG. 10.

A summary of the full cycle of operation of the strapping tool is as follows. In the starting condition shown in FIGS. 1 and 7 pressure air is being supplied through the sealing valve spool 80 to the underside of the piston 28 so that the crimping jaws 34 are held wide open. Pressure air is also being supplied by the tension valve spool 76 to the underside of the piston of the auxiliary piston and cylinder assembly 63. This holds the strap foot restrainer 59 in its upper position and the toe 48 of the strap foot 47 is separated from the back plate 37.

A metal seal 23 is slipped over the end of a length of strapping 21 drawn from a supply reel. The strapping is pulled through the seal and is looped around a package. The free end is threaded again through the seal below the supply end of the strapping loop and the projecting portion 101 (FIGS. 5 and 11) bent back under the seal. The end of the loop nearest the supply reel is inserted sideways into the tool between the rotary dog 50 and the roller 52. To create a gap for this purpose between the rotary dog 50 and the roller 52 the air motor 51 is lifted by squeezing together the air motor 51 and the hand lever 53. The seal 23 is arranged under the crimping jaws 34 and the strap foot occupies the angle between the strapping of the loop and the portion leading to the supply. The slack in the strapping is pulled up manually until the end of the seal abuts against the seal stop 41.

The operating lever 102 is then depressed and is held in this position by the bar 103. The resulting reversal of the pressure air supply to the auxiliary piston and cylinder assembly 63, so that it is now applied to the top of the piston, closes the strap foot restrainer 59 (as shown in FIG. 4), urges the strap foot 47 towards the back plate 37, and urges the rotary dog 50 against the strapping. Air pressure is simultaneously applied to the partial-close cylinder 71 partially to close the crimping jaws 34 to grasp and locate the seal, as shown in FIG. 8, and to the air motor 51 which drives the rotary dog 50 to tension the strapping.

The strapping is fully tensioned when the motor stalls. Meanwhile the pressure in the chamber 112 is gradually rising and after a time delay determined by the setting of the restrictor 113 air pressure is supplied to the sealing valve piston 105 which moves the sealing valve spool downwards to apply air pressure to the top of the piston 28. The crimping jaws 34, as shown in FIG. 9, form the joint between the overlapping ends of the loop of strapping and the cutter 44 co-operates with the toe 48 of the strap foot to cut off the loop from the supply of strapping. When the main piston 28 reaches the bottom of its stroke, on completing the crimping and cutting-off operation, it strikes the plunger 73 so that the operating lever 102 is released as previously described.

Release of the operation lever 102 allows the spool spring 77 to restore the tension valve spool 76 to its initial position. Back in its initial position, the tension valve spool cuts off the pressure air supply to the motor and to the sealing valve piston 105 so that the sealing valve spool 80 returns to its starting position in which it supplies air to the underside of the main piston 28, reopening the crimping jaws 34 so that the tool can be removed from the package. Return of the tension valve spool to its initial position applies air to the underside of the piston of the auxiliary piston and cylinder assembly 63 swinging the strap foot restrainer 59 up into the open postition and bringing its tail 69 into engagement with the abutment 70 to withdraw the strap foot 47 from the back plate 37 ready for the next loop of strapping. The form of the resulting joint is shown in FIG. 11.

The screw-down valve 100 allows air from the partial tension valve spool 76 to be cut off from the partial close cylinder 71 so that the intermediate movement of the crimping jaws 34 to grip the seal 23 as shown in FIG. 8 does not take place. This may be desirable for various operational reasons, for example, to run the tool along the strapping 21 for some distance up to the seal.

Figure 12:
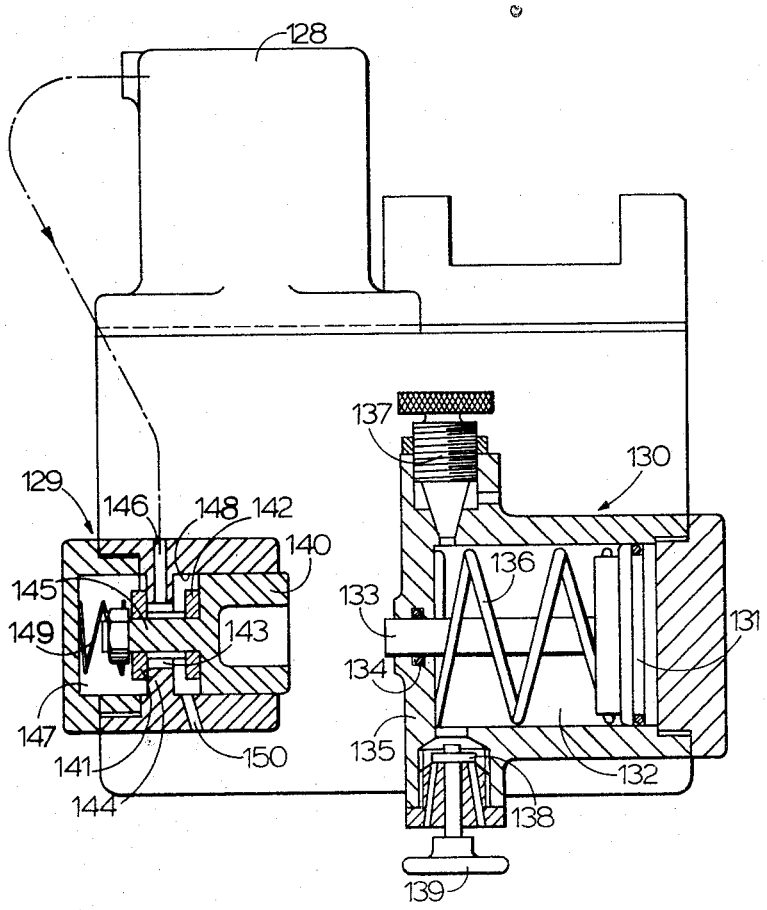

In the modification of FIG. 12 the sealing valve is operated by a sealing valve piston and cylinder similar to the piston 105 and cylinder 104 of the previous embodiment but contained in a housing 128 mounted on the top of the body 66 of the valve assembly 24. The time-delay device is mounted on the face of the body 66 and comprises, spaced apart, a pilot valve assembly 129 and a pilot valve operating piston and cylinder assembly 130.

The pilot valve operating piston and cylinder assembly 130 comprises a piston 131 working in a cylinder 132. A piston rod 133 extends from the piston through a gland 134 in the end wall 135 of the cylinder adjacent the pilot valve assembly 129. A compression spring 136 surrounding the piston rod 133 urges the piston 131 in an outward direction, to the right as viewed in FIG. 12. An adjustable restrictor 137 controls the effective area of a port close to the wall 135 and connecting the cylinder 132 to atmosphere. Also opening from atmosphere into the cylinder 132 close to the wall 135 is a passage controlled by a relief valve 138 which is self-operating when pressure in the cylinder 132 is sub-atmospheric. A push button 139 is provided from manual operation of the relief valve 138 when required, for example, in circumstances to be referred to later.

The cylinder 132 on the side of the piston opposite to the piston rod 133 is exposed to air supply pressure when the operating lever 102 is moved to start the tensioning means. The piston 131 begins to move to the left in FIG. 12 but its movement is resisted by the resulting compression of air in the part of the cylinder 132 around the piston rod 133. The setting of the restrictor 137 determines the rate at which this air can escape and therefore the time for the piston 131 to travel along the cylinder 132. As it moves the end of the piston rod 133 approaches the pilot valve assembly 129.

The pilot valve assembly comprises a double acting valve having an axially movable carrier piston 140 with spaced valve members 141, 142 to engage seatings on opposite sides of an opening 143 through a partition wall 144. A shank 145 of the carrier piston 140 passes through the opening 143 but leaving substantial clearance for the passage of air. A passage 146 in the partition wall 144 communicating with the opening 143 is connected to the top of the sealing valve cylinder in the housing 128. The partition wall 144 separates a chamber 147 from a cylinder 148 in which the carrier piston 140 works. The chamber 147 is exposed to air supply pressure while the operating lever 102 is in the position for supplying air to the tensioning means. Normally the valve member 141 in the chamber 147 is held against its seat by a light spring 149. When the valve member 141 is seated the valve member 142 is held off its seat so that the top of the sealing valve cylinder in the housing 128 is open to atmosphere through the passages 146, opening 143, cylinder 148 and a port 150 in the wall of the cylinder 148.

When the piston rod 133 has moved sufficiently far to the left (in FIG. 12) it engages the carrier piston 140 which then also moves to the left seating valve member 142 and unseating valve member 141. This shuts off the top of the sealing valve cylinder from atmosphere and exposes it to air supply pressure so that the seal valve piston is moved downwards to operate the sealing valve spool as in the previous embodiment.

The time-delay so introduced between the starting of the tensioning means and the operation of the jointing means depends not only upon the setting of the restrictor 137 as previously described but also upon the distance the piston rod 133 must travel before engaging the carrier piston 140 and therefore upon the distance separating the pilot valve operating assembly from the pilot valve assembly.

When the jointing means has completed the joint the operating lever 102 is returned to its "off" position as described in the previous embodiment cutting off air supply pressure from the cylinder 132 and the chamber 147. The spring 136 moves the piston 131 to the right and withdrawal of the piston rod 133 from the carrier piston 140 enables the spring 149 to close the valve member 141 and open the valve member 142 releasing the pressure in the sealing valve cylinder so that the spring 81 can move the sealing valve spool upwards to restore the jointing means to its starting position as described for the previous embodiment.

If automatic sealing is not required (for instance when strapping bales and the like for which a long period is required for tensioning the strapping and allowing the package to consolidate) the restrictor 137 can be screwed right down to prevent air escaping from behind the piston 131 in the cylinder 132. The jointing means can then be started manually at the appropriate time by operating the push button 139 to open the relief valve 138. The push button 139 can also be used to avoid the full time-delay and enable the jointing means to be operated earlier, if desired.

I claim:

1. A fluid-pressure operated package strapping tool of the kind which includes tensioning means for tightening a loop of strapping around a package and jointing means for securing together overlapped portions of the loop, both the tensioning means and the jointing means being powered by pneumatic or hydraulic fluid-pressure characterised in that the tool comprises means for initiating the jointing operation of the jointing means including a time-delay device the timing cycle of which is started by the application of fluid-pressure to the tensioning means.

2. A fluid-pressure operated package strapping tool according to claim 1 wherein the time-delay device is adjustable to vary the time-delay.

3. A fluid-pressure operated package strapping tool according to claim 1 wherein the time-delay device is pneumatic or hydraulic and uses for its own operation the fluid which is supplied under pressure to operate the tool.

4. A fluid-pressure operated package strapping tool according to claim 3 wherein the time-delay device is connected to the supply of fluid pressure to the tensioning means whereby the supply of fluid pressure to the tensioning means starts the timing cycle.

5. A fluid-pressure operated package strapping tool according to claim 4 wherein the time-delay device comprises a restrictor in a passage supplying fluid pressure to a chamber open to pressure-sensitive means arranged to control the supply of fluid under pressure to the jointing means.

6. A fluid-pressure operated package strapping tool according to claim 5 and further comprising a pilot valve actuable by the pressure-sensitive means operates a servo system actuable by the pilot valve and a sealing valve actuable by the servo system and controlling the supply of fluid under pressure to the jointing means.

7. A fluid-pressure operated package strapping tool according to claim 6 wherein the pilot valve is biassed towards the closed position by the supply pressure against which it must be opened by the pressure-sensitive means, the relative effective areas of the pressure-sensitive means and the pilot valve being such that when the pressure in the chamber reaches a pre-determined value, the pressure-sensitive means opens the pilot valve to operate the jointing means.

8. A fluid-pressure operated package strapping tool according to any one of preceding claim 5 wherein the restrictor is adjustable for setting or varying the time-delay.

9. A fluid-pressure operated package strapping tool according to any one of preceding claim 5 wherein the volume of the chamber is variable for setting or varying the time-delay.

10. A fluid-pressure operated package strapping tool according to claim 1 wherein the time-delay device is connected to the supply of fluid pressure to the tensioning means and comprises a piston working in a cylinder, means operable by the piston towards the end of an outward stroke of the piston for initiating the operation of the jointing means, means for exposing one side of the piston to the fluid pressure applied to the tensioning means so as to urge the piston in the outward direction and a restrictor controlling the escape of fluid from the cylinder on the other side of the piston so as to impose a time-delay between the application of fluid pressure to the tensioning means and the operation by the piston of the means for initiating the operation of the jointing means.

11. A fluid-pressure operated package strapping tool according to claim 10 wherein the means operable by the piston for initiating the operation of the jointing means comprises a pilot valve in a servo system controlling the jointing means, the piston having a piston rod which engages and operates the pilot valve towards the end of the outward stroke of the piston.

12. A fluid-pressure operated package strapping tool according to claim 10 wherein the restriction is adjustable to vary the time-delay.

13. A fluid-pressure operated package strapping tool according to claim 1 wherein means is provided for direct manual control of the jointing means, when required, to replace or override the time-delay.

14. A fluid-pressure operated package strapping tool according to claim 1 wherein is provided means for holding in the actuation position a valve supplying fluid under pressure to the tensioning means and means for releasing the holding means on completion of the movement of the jointing means in the direction for making the joint.

15. A fluid-pressure operated package strapping tool according to claim 14 and further comprising a jointing or sealing piston and cylinder assembly for operating the jointing means, wherein the releasing means comprises a member engaged by the jointing or sealing piston at the end of its travel, a self-engaging latch forming the holding means and a linkage interconnecting said member and the self-engaging latch, the self-engaging latch engaging automatically when the valve supplying fluid under pressure to the tensioning means is actuated so as to retain the tensioning valve in the actuated condition.

* * * * *